US008966802B1

(12) United States Patent
Findlay

(10) Patent No.: US 8,966,802 B1
(45) Date of Patent: Mar. 3, 2015

(54) TRIGGER RETURN AND DROP PENDULUM

(71) Applicant: Smith & Wesson Corp., Springfield, MA (US)

(72) Inventor: David S. Findlay, Athol, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/080,036

(22) Filed: Nov. 14, 2013

(51) Int. Cl.
*F41A 19/10* (2006.01)
*F41A 19/12* (2006.01)

(52) U.S. Cl.
CPC ..... *F41A 19/10* (2013.01); *F41A 19/12* (2013.01)
USPC ..... 42/69.01; 42/70.04

(58) Field of Classification Search
USPC ..... 42/69.01, 69.02, 70.01–70.07
See application file for complete search history.

(56) References Cited

U.S. PATENT DOCUMENTS 2,675,638 A * 4/1954 Crittendon ..... 42/69.01
2,765,562 A 10/1956 Roper et al.
2,856,718 A * 10/1958 Fischer ..... 42/70.05
3,707,796 A 1/1973 Bielfeldt
3,747,251 A 7/1973 Baker
3,975,852 A * 8/1976 Findlay ..... 42/40
4,301,609 A 11/1981 Peterson et al.
4,897,951 A * 2/1990 Osborne ..... 42/70.06
5,067,266 A * 11/1991 Findlay ..... 42/70.08
5,373,775 A * 12/1994 Findlay et al. ..... 89/137
5,697,178 A 12/1997 Haskell
5,784,818 A 7/1998 Otteson
5,857,280 A * 1/1999 Jewell ..... 42/69.03
6,240,670 B1 * 6/2001 Findlay ..... 42/70.08
6,553,706 B1 4/2003 Gancarz et al.
6,813,854 B2 11/2004 Popikow
7,377,067 B2 5/2008 Werner
7,617,628 B2 * 11/2009 Curry ..... 42/70.02
7,690,144 B2 4/2010 Fagundes de Campos

* cited by examiner

*Primary Examiner* — Michael David
(74) *Attorney, Agent, or Firm* — John A. Chionchio, Esquire; Ballard Spahr LLP

(57) ABSTRACT

A trigger assembly has a sear with a stop surface engageable with a reciprocating component for holding the reciprocating component in a cocked configuration. The sear also has a sear cam engageable with a lever movably mounted within the assembly. A trigger is movable into and out of engagement with the lever. Pulling the trigger moves it out of engagement with the lever and releases the sear. A trigger return pendulum has a trigger cam engageable with the trigger, a lever cam engageable with the lever, and a head cam follower engageable with the reciprocating component. Motion of the reciprocating component acting through the head cam follower of the trigger return pendulum forces the lever cam into engagement with the lever and the trigger cam into engagement with the trigger to return the lever and the trigger to a configuration of engagement between the trigger and the lever.

34 Claims, 6 Drawing Sheets

TRIGGER RETURN AND DROP PENDULUM

FIELD OF THE INVENTION

This invention relates to an improved trigger mechanism for firearm fire control.

BACKGROUND

Trigger sensation (i.e., trigger pull weight, creep and feel) and safety are important issues in the operation of a firearm's fire control. Too often in the design of firearm fire control mechanisms, these two factors are seen as being in opposition to one another in that an increase in safety of operation comes at the expense of a decrease in trigger sensation and vice versa. However, it is both desirable and possible to improve both the safety and trigger sensation of firearms, using an improved trigger mechanism according to the invention disclosed in this specification that does not require a two-stage trigger feel found objectionable by many shooters.

SUMMARY

One aspect of the invention relates to a trigger assembly for a firearm. The firearm has a reciprocating component. In one example embodiment, the trigger assembly comprises a sear movably mounted within the assembly. The sear has a stop surface engageable with the reciprocating component for holding the reciprocating component in a cocked configuration. The sear further comprises a sear cam. A lever is movably mounted within the assembly. The lever has a contact surface. The sear cam engages the lever. A trigger is movably mounted within the assembly. The trigger has an action surface movable into and out of engagement with the contact surface upon motion of the trigger. A lever return spring acts on the lever and biases the contact surface out of engagement with the action surface. A trigger return pendulum is movably mounted within the assembly. The trigger return pendulum has a trigger cam engageable with the trigger. A lever cam is engageable with the lever. A head cam follower is engageable with the reciprocating component. In this example embodiment, motion of the reciprocating component acts through the head cam follower of the trigger return pendulum and forces the lever cam into engagement with the lever, and the trigger cam into engagement with the trigger, to return the lever and the trigger to a configuration of engagement between the action surface and the contact surface.

In a particular example embodiment, the sear is pivotably mounted on a sear fulcrum. By way of example, the stop surface is angularly oriented relatively to a line of motion of the reciprocating component to permit the reciprocating component to pivot the sear about the sear fulcrum upon motion of the reciprocating component along the line of motion against the stop surface.

In another example embodiment, the lever is pivotably mounted on a lever fulcrum. In a further example embodiment, the sear cam engages the lever on one side of the lever fulcrum and the contact surface is positioned on the one side of the lever fulcrum.

In a specific example embodiment, the trigger is pivotably mounted on a trigger fulcrum. By way of example, the trigger comprises an actuation arm and a projection extending transversely thereto. The projection is engageable with the trigger cam. By way of example, the trigger may be balanced about the trigger fulcrum.

In another example embodiment, the trigger return pendulum is pivotably mounted on a trigger return pendulum fulcrum. By way of a further example, the lever cam engages the lever on an opposite side of the lever fulcrum from the contact surface. In another example, the trigger return pendulum fulcrum is positioned at one end of the trigger return pendulum, and the lever cam is positioned at an opposite end of the trigger return pendulum. In this example the trigger cam is positioned between the ends of the trigger return pendulum.

A particular example embodiment further comprises first and second plates attached to one another in spaced apart relation. In this example, the sear, the lever, the trigger and the trigger return pendulum are mounted between the sideplates. By way of further example, the sear fulcrum, the lever fulcrum, the trigger fulcrum and the trigger return pendulum fulcrum each comprises a respective pin extending between the sideplates.

The invention further encompasses a trigger assembly for a firearm having a reciprocating component wherein the trigger assembly comprises first and second sideplates arranged in parallel, spaced apart relation. In this example, a sear pin extends between the first and second sideplates. A sear is pivotally mounted on the sear pin. The sear has a stop surface engageable with the reciprocating component for holding the reciprocating component in a cocked configuration. The sear further comprises a sear cam. A lever pivot pin extends between the first and second sideplates. A lever is pivotally mounted on the lever pivot pin. The lever has a contact surface. The sear cam engages the lever. A trigger pivot pin extends between the first and second sideplates. A trigger is pivotally mounted on the trigger pivot pin. The trigger has an action surface movable into and out of engagement with the contact surface upon motion of the trigger. A lever return spring acts on the lever and biases the contact surface out of engagement with the action surface. A trigger return pendulum pin extends between the first and second sideplates. A trigger return pendulum is pivotally mounted on the trigger return pendulum pin. The trigger return pendulum has a trigger cam engageable with the trigger. A lever cam is engageable with the lever. A head cam follower is engageable with the reciprocating component. In this example embodiment, motion of the reciprocating component acting through the head cam follower of the trigger return pendulum forces the lever cam into engagement with the lever and the trigger cam into engagement with the trigger to return the lever and the trigger to a configuration of engagement between the action surface and the contact surface.

In a particular example embodiment, the stop surface is angularly oriented relatively to a line of motion of the reciprocating component to permit the reciprocating component to pivot the sear about the sear pin upon motion of the reciprocating component along the line of motion against the stop surface. By way of example, the sear cam engages the lever on one side of the lever pivot pin and the contact surface is positioned on the one side of the lever pivot pin. In a particular example embodiment, the trigger comprises an actuation arm and a projection extending transversely thereto. In this example embodiment, the projection is engageable with the trigger cam. Further by way of example, the trigger may be balanced about the trigger pivot pin. In an example embodiment, the lever cam engages the lever on an opposite side of the lever pivot pin from the contact surface. Further by way of example, the trigger return pendulum pin may be positioned at one end of the trigger return pendulum, the lever cam may be positioned at an opposite end of the trigger return pendulum, and the trigger cam may be positioned between the ends of the trigger return pendulum.

The invention further encompasses a firearm. In a particular example embodiment, the firearm comprises a reciprocating component and a trigger assembly comprising a sear movably mounted within the assembly. The sear has a stop surface engageable with the reciprocating component for holding the reciprocating component in a cocked configuration. The sear further comprises a sear cam in this example embodiment. A lever is movably mounted within the assembly. The lever has a contact surface. The sear cam engages the lever. A trigger is movably mounted within the assembly. The trigger has an action surface movable into and out of engagement with the contact surface upon motion of the trigger. A lever return spring acts on the lever and biases the contact surface out of engagement with the action surface. A trigger return pendulum is movably mounted within the assembly. The trigger return pendulum has a trigger cam engageable with the trigger. A lever cam is engageable with the lever, and a head cam follower is engageable with the reciprocating component. In this example embodiment, motion of the reciprocating component acting through the head cam follower of the trigger return pendulum forces the lever cam into engagement with the lever, and the trigger cam into engagement with the trigger to return the lever and the trigger to a configuration of engagement between the action surface and the contact surface.

By way of example, the sear is pivotably mounted on a sear fulcrum. In an example embodiment, the stop surface is angularly oriented relatively to a line of motion of the reciprocating component to permit the reciprocating component to pivot the sear about the sear fulcrum upon motion of the reciprocating component along the line of motion against the stop surface. By way of example, the lever may be pivotably mounted on a lever fulcrum.

In an example embodiment, the sear cam engages the lever on one side of the lever fulcrum and the contact surface is positioned on the one side of the lever fulcrum. By way of further example, the trigger may be pivotably mounted on a trigger fulcrum. In a particular example embodiment the trigger comprises an actuation arm and a projection extending transversely thereto, the projection being engageable with the trigger cam. In this example embodiment, the trigger may be balanced about the trigger fulcrum and the lever may be balanced about the lever fulcrum. By way of example, the trigger return pendulum may be pivotably mounted on a trigger return pendulum fulcrum. In an example embodiment, the lever cam engages the lever on an opposite side of the lever fulcrum from the contact surface.

In a particular example embodiment, the trigger return pendulum fulcrum is positioned at one end of the trigger return pendulum, the lever cam is positioned at an opposite end of the trigger return pendulum, and the trigger cam is positioned between the ends of the trigger return pendulum.

By way of further example, the firearm may comprise first and second sideplates attached to one another in spaced apart relation. The sear, the lever, the trigger and the trigger return pendulum are mounted between the sideplates in this example. By way of example, the sear fulcrum, the lever fulcrum, the trigger fulcrum and the trigger return pendulum fulcrum each may comprise a respective pin extending between the sideplates. In a particular example embodiment, the firearm comprises a bolt action rifle and the reciprocating component comprises a firing pin head. In another example embodiment, the firearm comprises a semi-automatic rifle and the reciprocating member comprises a bolt carrier. By way of further example, the firearm may comprise an automatic rifle and the reciprocating member may comprise a bolt carrier. In another example embodiment, the firearm comprises a pistol and the reciprocating member comprises a slide.

DETAILED DESCRIPTION

Figure 1:
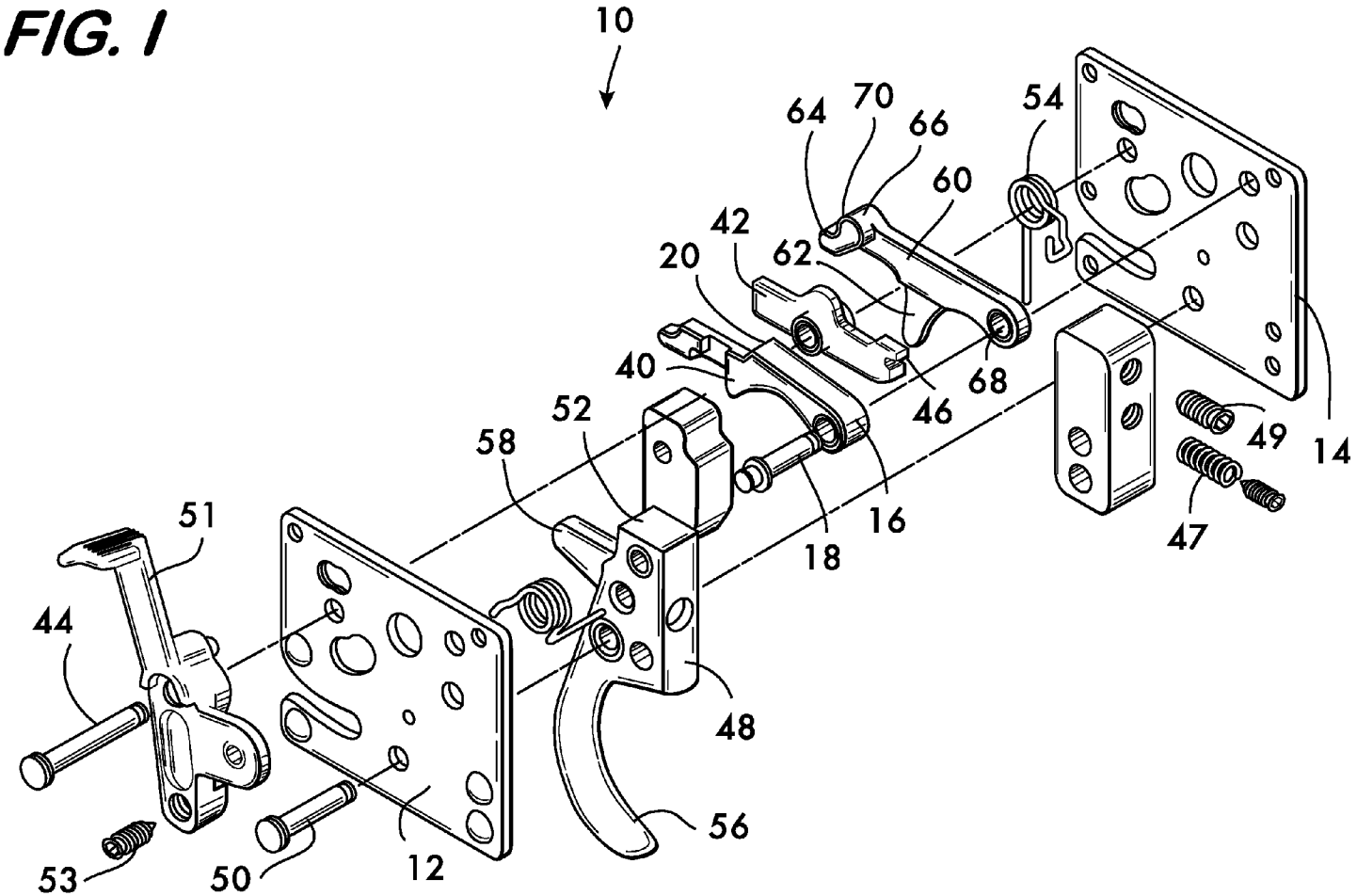
FIG. 1 is an exploded isometric view of an example embodiment of a trigger mechanism according to the invention.
Figure 2:
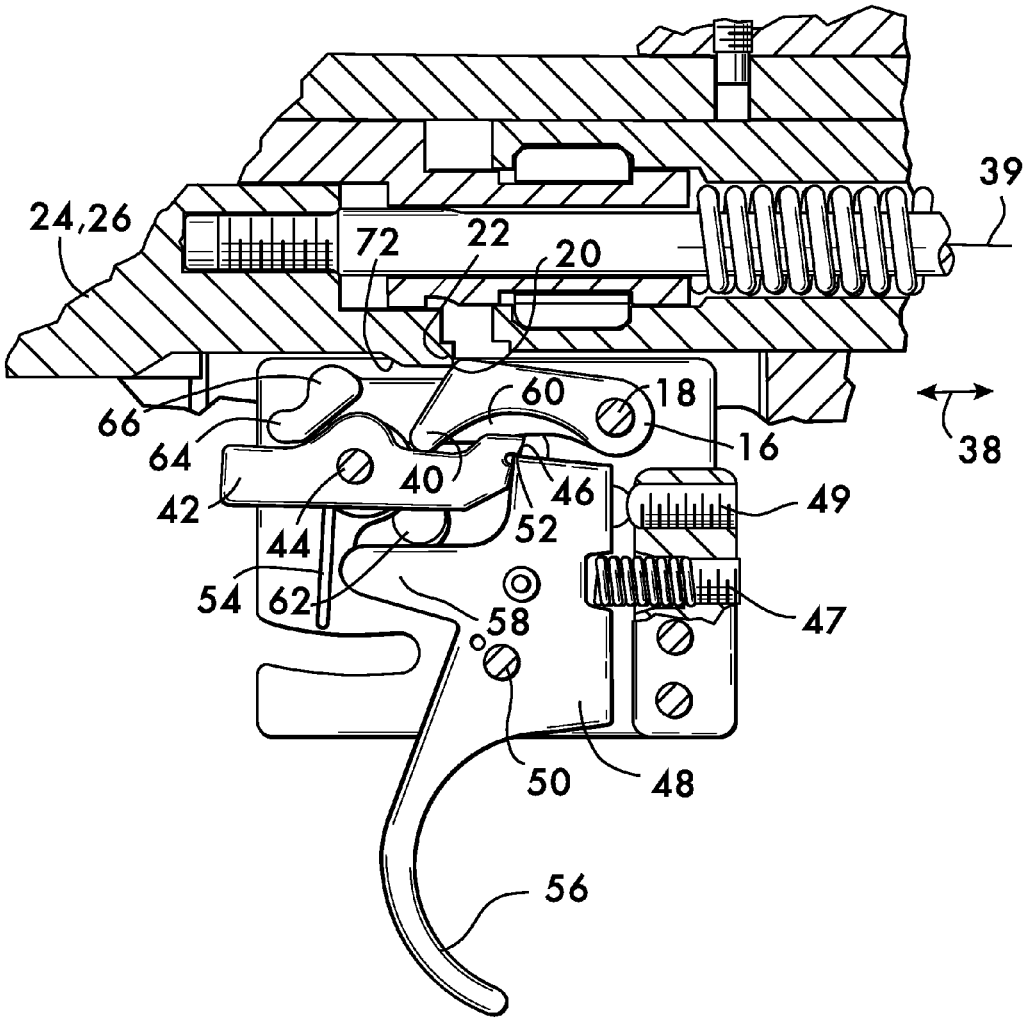
FIG. 2 is a right side assembled view of the trigger mechanism shown in FIG. 1.
Figure 3:
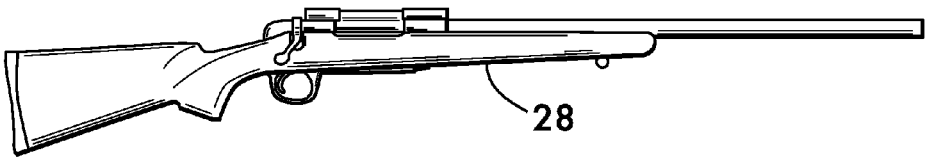
FIGS. 3-5 are side views of example firearms with which the trigger mechanism according to the invention may be used.
Figure 4:
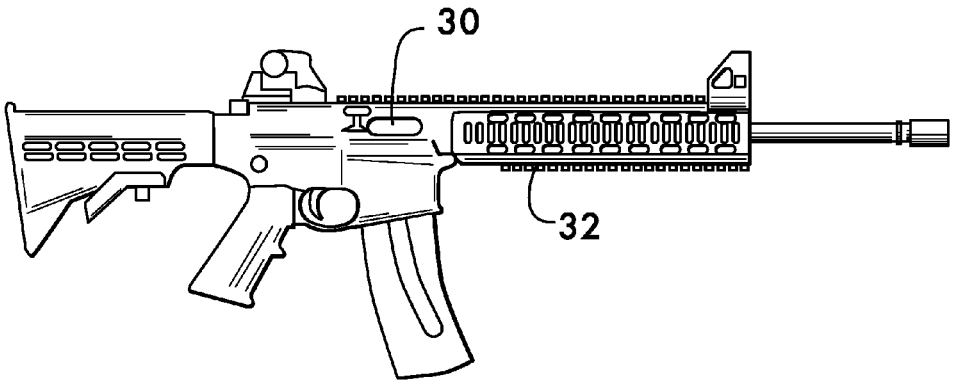
Figure 5:
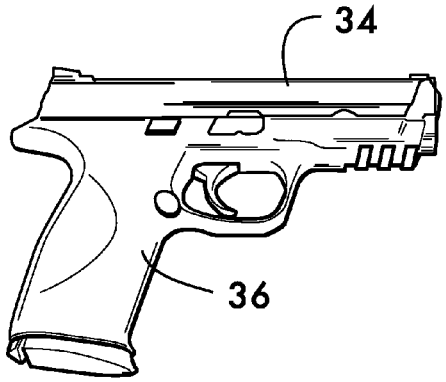

FIG. 1 shows an exploded view of an example trigger assembly 10 for a firearm according to the invention. Trigger assembly 10 comprises first and second sideplates 12 and 14 arranged in a parallel, spaced apart relation. A sear 16 is movably mounted within the assembly 10 between sideplates 12 and 14. In this example embodiment, sear 16 is pivotably mounted on a sear fulcrum comprising a sear pin 18 extending between sideplates 12 and 14. Sear 16 comprises a stop surface 20 that is engageable with a surface 22 of a reciprocating component 24, shown in FIG. 2. In this example, the reciprocating component is a firing pin head 26 of a bolt action rifle 28 (see FIG. 3), but in other example embodiments the reciprocating component may comprise a bolt carrier 30 of an automatic or semi-automatic rifle 32 (see FIG. 4) or the slide 34 of a semi-automatic pistol 36 (see FIG. 5). As shown in FIG. 2, stop surface 20 holds the reciprocating component 24 in a cocked position when engaged with surface 22, the reciprocating component being reciprocally movable relatively to sear 16 along a line of motion show by arrow 38 parallel to a firing axis 39 of the firearm. It is advantageous to orient the stop surface angularly with respect to the line of motion 38 as the angular geometry facilitates release of the reciprocating component 24 and pivoting of the sear 16 when the sear pivots on its fulcrum/pin 18 as described below.

As shown in FIGS. 1 and 2, a sear cam 40 is mounted on sear 16. In this example embodiment, the sear cam 40 comprises a lobe projecting away from the stop surface 20 and engaging a lever 42. Lever 42 is movably mounted within the assembly 10 between sideplates 12 and 14. Mounting is via a lever pivot pin 44 extending between the sideplates to provide a lever fulcrum permitting pivoting motion. A contact surface 46 is positioned on lever 42 on the same side of the lever pivot pin 44 that the sear cam 40 engages the lever. A trigger 48 is movably mounted within the assembly 10 between sideplates 12 and 14. Trigger 48 is mounted on a trigger pivot pin 50 that extends between the sideplates and provides a trigger fulcrum permitting pivoting motion of trigger 48. An action surface 52 is positioned on the trigger 48. Upon pivoting of trigger 48 about its pin 50, the action surface 52 is movable into and out of engagement with the contact surface 46 of the lever 42 (compare FIGS. 6 and 7). With reference again to FIGS. 1 and 2, a lever return spring 54 biases the lever 42 in a counterclockwise sense (when viewed from the right side of the firearm) to force the lever's contact surface 46 away from the action surface 52 of the trigger 48. A trigger pull spring 47 biases the trigger in a counterclockwise sense about its pin 50 and a trigger overtravel screw 49 limits the clockwise rotation of the trigger about pin 50. When trigger 48 pivots to move the action surface 52 out of engagement with the contact surface 46, lever 42 pivots clockwise under the action of sear 16. Sear 16 rotates counterclockwise from the force of firing pin head 26 acting along line of motion 38 through engagement between surface 22 of the firing pin head 26 and angled stop surface 20 of the sear 16. Counterclockwise rotation of sear 16 forces clockwise rotation of lever 42 (overcoming its biasing spring 54) through engagement between the sear cam 40 and the lever 42.

Trigger 48 comprises an actuation arm 56 (the curved portion that receives a finger of a shooter) and a projection 58 that extends transversely to the actuation arm 56. It is advantageous to balance the trigger 48 about the trigger pivot pin 50 so that there is no net torque from the part's mass about the trigger fulcrum; i.e., the trigger will not tend to rotate under the influence of gravity or inertial forces. Balancing the trigger helps prevent unintended discharge of the firearm when dropped. It is also advantageous to balance lever 42 about its fulcrum pin 44 so that there is no net torque from the part's mass about the lever fulcrum. Balancing the lever also helps prevent unintended discharge of the firearm when dropped. A safety 51 having a safety/trigger detent screw 53 is mounted on sideplate 12.

A trigger return pendulum 60 is movably mounted within the assembly 10 between sideplates 12 and 14. Trigger return pendulum 60 is mounted on a trigger return pendulum pin 18 that extends between the sideplates and provides a fulcrum permitting pivoting motion of the trigger return pendulum 60. (In this example embodiment the trigger return pendulum 60 shares the same pin as the sear 16.) Trigger return pendulum 60 comprises a trigger cam 62, a lever cam 64, and a head cam follower 66. In the example embodiment disclosed herein, the trigger return pendulum fulcrum (pin 18) is positioned at one end 68 of the trigger return pendulum 60. Lever cam 64 and the head cam follower 66 are positioned at an opposite end 70 of the trigger return pendulum from the fulcrum, and the trigger cam 62 is positioned between ends 68 and 70 of the trigger return pendulum 60. With this configuration of trigger return pendulum 60 the lever cam 64 can engage the lever 42 on an opposite side of the lever pivot pin 44 from the lever's contact surface 46, and the trigger cam 62 can engage the trigger projection 58 upon pivoting motion of the trigger return pendulum about pin 18. As shown in FIGS. 2 and 6-8, the head cam follower 66 is engageable with a cam 72 on the reciprocating component 24 when the action of the firearm is worked as described below.

Figure 6:
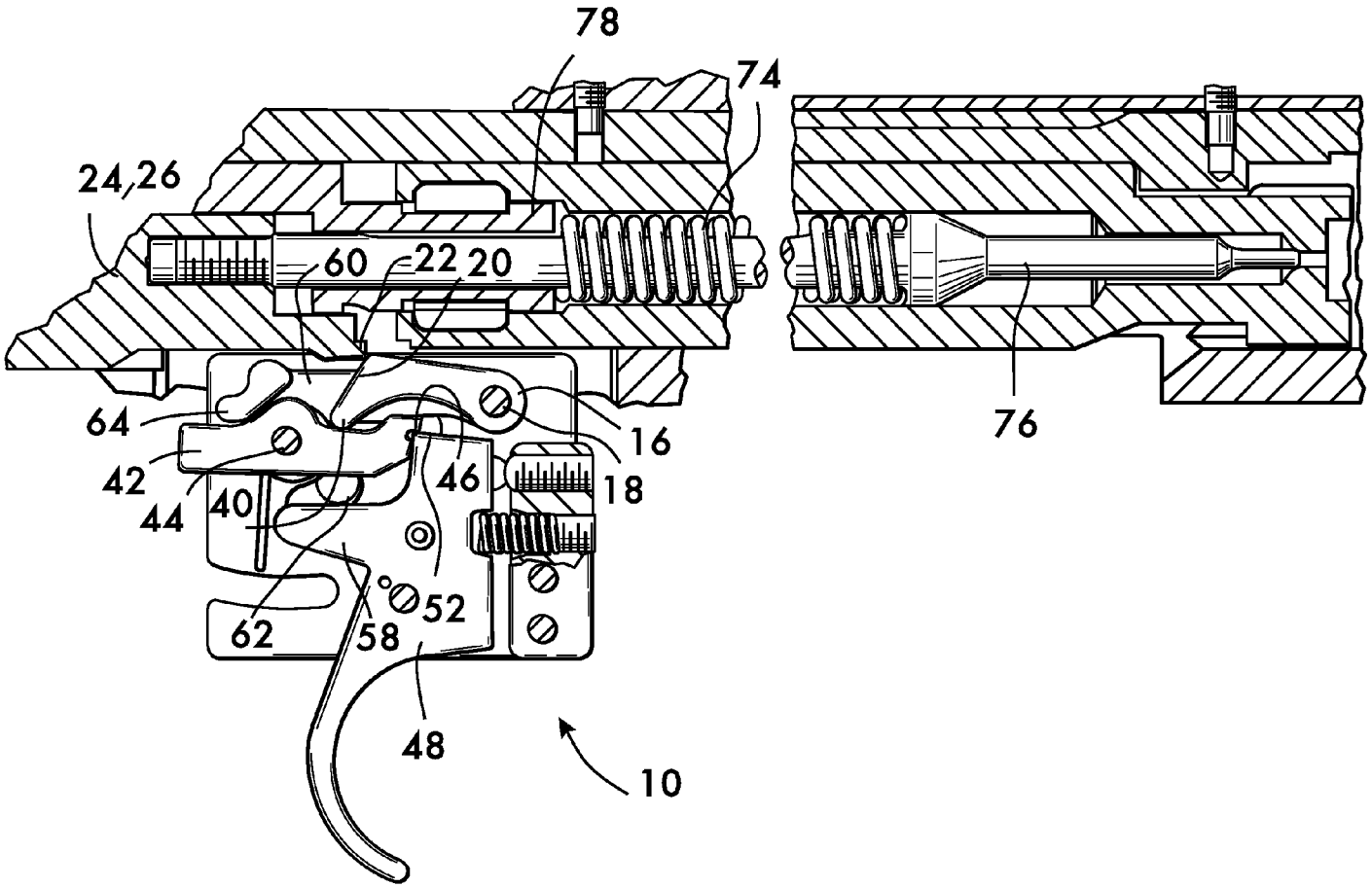
FIGS. 6-8 are right side views illustrating operation of the trigger mechanism of FIG. 1 in a bolt action rifle.

Operation of the trigger assembly 10 is described with reference to FIGS. 6-8. As shown in FIG. 6, the firearm is ready to fire. The firing pin head 26 (i.e., reciprocating component 24) is held in the cocked position (i.e., firing pin spring 74 compressed between the firing pin 76 and the rifle's tail piece 78) by the stop surface 20 of sear 16 engaging the surface 22 of the firing pin head 26. In this state, the firing pin 76 is prevented from moving toward the chamber 80 by the sear 16. Sear 16 is prevented from rotating counterclockwise about its fulcrum pin 18 because the action surface 52 of trigger 48 engages the contact surface 46 of the lever 42 and holds the sear cam 40 against the lever 42. Trigger cam 62 of trigger return pendulum 60 rests on the projection 58 of the trigger 48, and the lever cam 64 of the trigger return pendulum is positioned adjacent to a portion of lever 42 on the opposite side of the lever pivot pin 44 from the lever contact surface 46.

Figure 7:
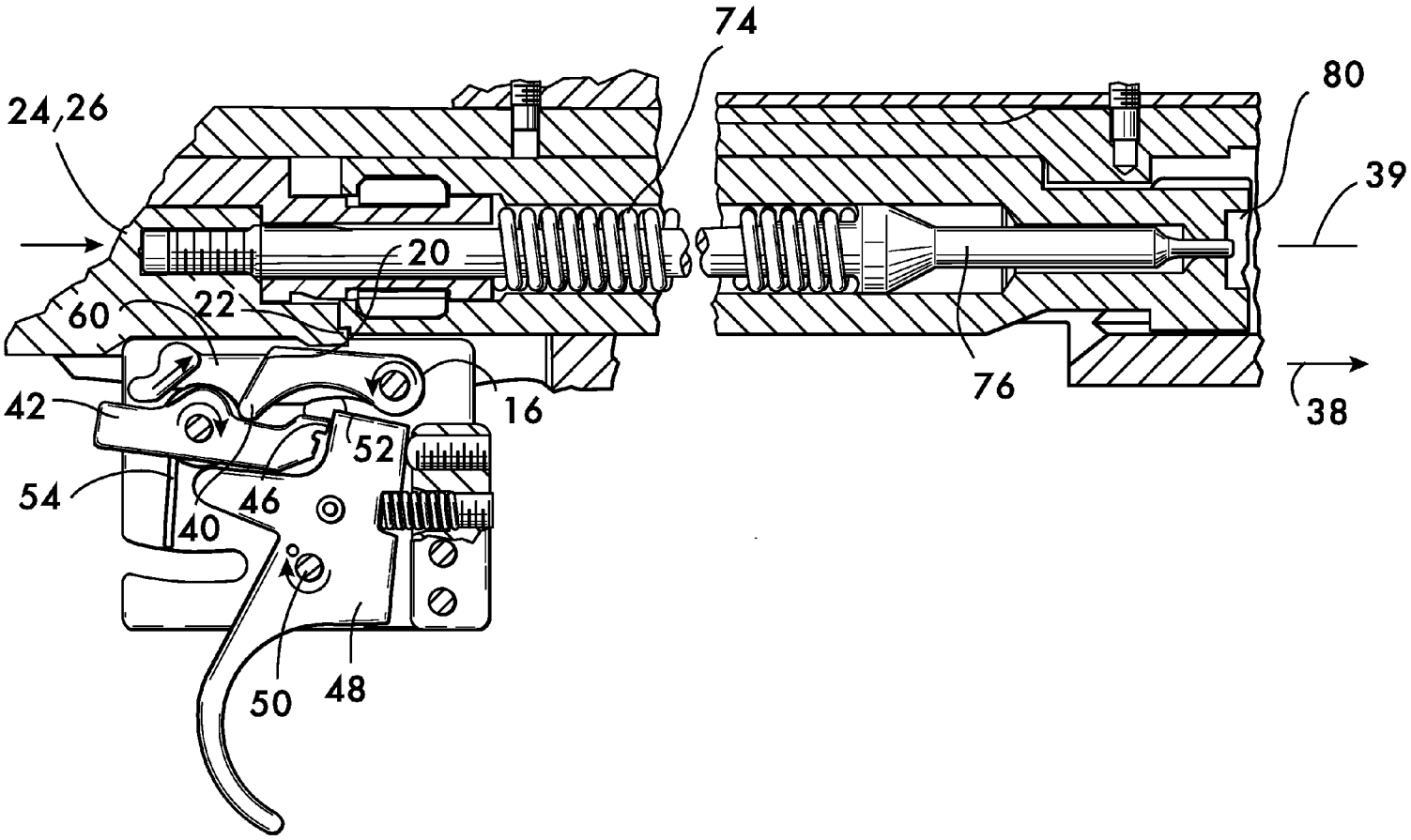

As shown in FIG. 7, a pull of trigger 48 rotates the trigger about trigger pivot pin 50 and disengages action surface 52 from the contact surface 46 of the lever 42. Lever 42 is forced to rotate clockwise under the action of the force of the firing pin spring 74 acting through the angled stop surface 20 of sear 16, which communicates this force to the lever 42 through contact between the sear cam 40 and the lever. Clockwise rotation of the lever 42 permits counterclockwise rotation of the sear 16, causing the stop surface 20 to fall off of the surface 22 of the firing pin head 26. This permits the firing pin head 26 to move along its line of motion 38 parallel to the firing axis 39 under the force of its spring 74. Firing pin 76 is thus driven toward chamber 80 to discharge a chambered round.

Figure 8:
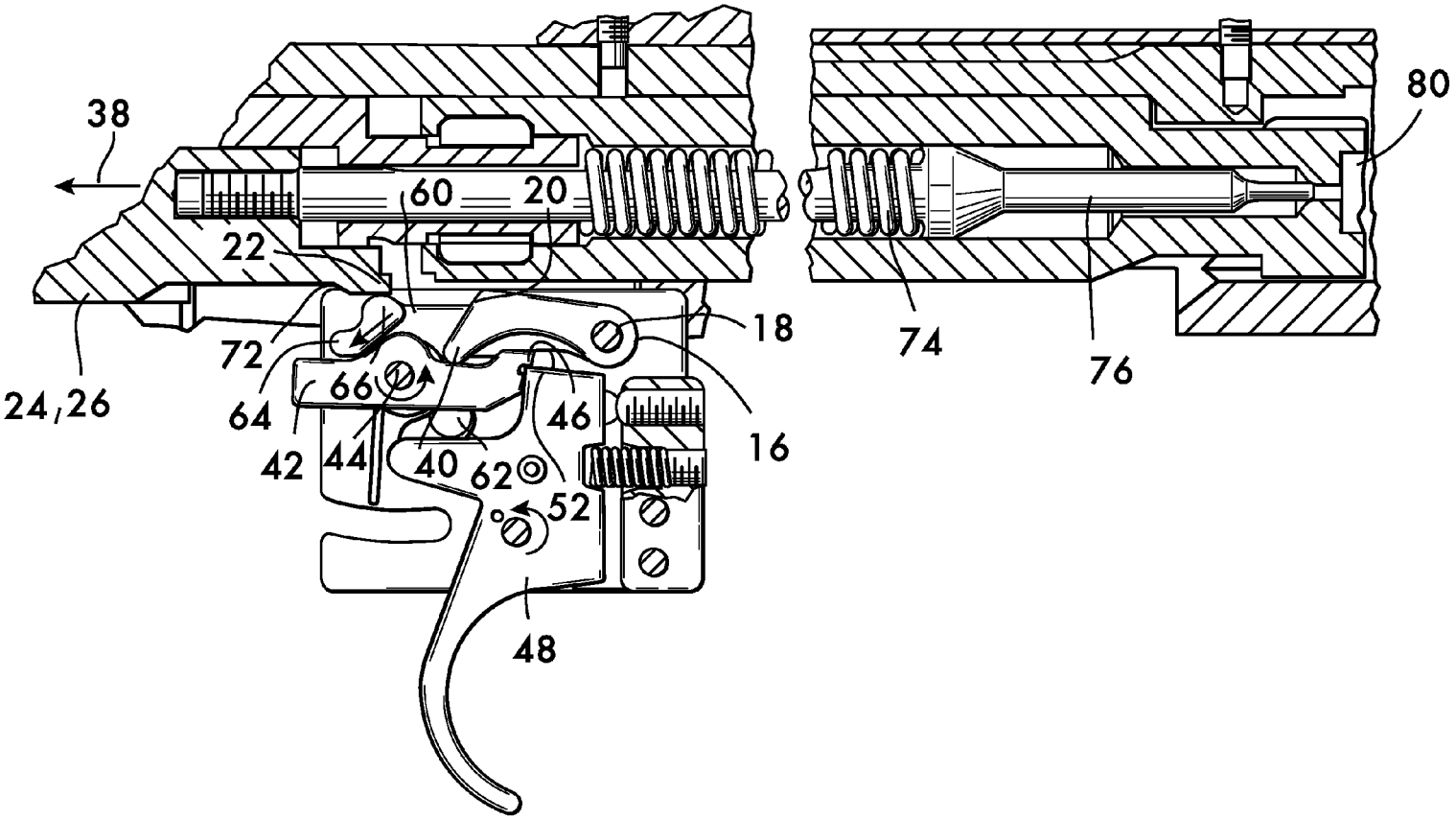

As shown in FIG. 8, the firing pin head 26 is drawn along its line of motion 38 away from chamber 80. For the bolt action rife (FIG. 3) this is accomplished by rotating the bolt to unlock it from the barrel and manually pulling the bolt away from the chamber. Motion of the bolt away from chamber 80 extracts the spent cartridge from the chamber and opens the action of the rifle, allowing another round to be chambered. As the firing pin head moves along its line of motion 38 away from the chamber 80 the cam 72 engages the head cam follower 66 on the trigger return pendulum 60. Engagement between the cam 72 and the head cam follower 66 causes the trigger return pendulum 60 to rotate counterclockwise about the pin 18. During rotation of the trigger return pendulum 60, the lever cam 64 first engages the lever 42, causing it to rotate counterclockwise about lever pivot pin 44. Rotation of the lever 42 causes it to engage the sear cam 40 and rotate the sear 16 about pin 18, moving the stop surface 20 of the sear into a position where it will again engage surface 22 of the firing pin head 26 to hold it in the cocked position. Rotation of the lever 42 also moves the contact surface 46 of the lever 42 into a position where it can again engage the action surface 52 of trigger 48. Further during counterclockwise rotation of the trigger return pendulum 60, the trigger cam 62 engages the projection 58 of the trigger 48, causing the trigger to rotate counterclockwise to bring its action surface 52 into engagement with the contact surface 46 of the lever 42. The geometry of the trigger return pendulum 60, the lever 42 and the trigger 48 are such that the lever and trigger move smoothly into position without binding to ensure engagement between the action surface 52 and the contact surface 46 once the bolt is closed and the rifle is brought once again into the fire configuration (FIG. 6) wherein surface 22 of bolt head 26 is engaged with stop surface 20 of sear 16. Once these surfaces are engaged, the sear 16 is stable, supported by contact between the sear cam 40 and the lever 42, and, until the trigger is again pulled, able to reliably hold the firing pin head 26 in the cocked position of FIG. 6. Motion of firing pin head 26 along its line of action 38 causes trigger 48 and lever 42 to be influenced into engagement through each motion of opening and closing the bolt.

Trigger return pendulum 60 also acts as a "drop pendulum" to prevent inadvertent discharge of the firearm if dropped. As shown in FIG. 6, the trigger cam 62 is engaged with the projection 58 of trigger 48 when the firearm is cocked. Inertial forces acting on the mechanism as a result of the firearm being dropped will tend to keep the trigger cam 62 engaged with the projection 58, thereby preventing rotation of the trigger (which is also balanced, further inhibiting any tendency to rotate). Inertial forces which might tend to rotate the trigger return pendulum 60 clockwise so that trigger cam 62 lifts off the projection 58 will be countered by the head cam follower 66 contacting and bouncing off of the firing pin head 26.

What is claimed is:

1. A trigger assembly for a firearm having a reciprocating component, said trigger assembly comprising:

a sear movably mounted within said assembly, said sear having a stop surface engageable with said reciprocating component for holding said reciprocating component in a cocked configuration, said sear further comprising a sear cam;

a lever movably mounted within said assembly, said lever having a contact surface, said sear cam engaging said lever;

a trigger movably mounted within said assembly, said trigger having an action surface movable into and out of engagement with said contact surface upon motion of said trigger;

a spring acting on said lever and biasing said contact surface out of engagement with said action surface;

a trigger return pendulum movably mounted within said assembly, said trigger return pendulum having a trigger cam engageable with said trigger, a lever cam engageable with said lever, and a head cam follower engageable with said reciprocating component; wherein motion of said reciprocating component acting through said head cam follower of said trigger return pendulum forces said lever cam into engagement with said lever and said trigger cam into engagement with said trigger to return said lever and said trigger to a configuration of engagement between said action surface and said contact surface.

2. The trigger assembly according to claim 1, wherein said sear is pivotably mounted on a sear fulcrum.

3. The trigger assembly according to claim 2, wherein said stop surface is angularly oriented relatively to a line of motion of said reciprocating component to permit said reciprocating component to pivot said sear about said sear fulcrum upon motion of said reciprocating component along said line of motion against said stop surface.

4. The trigger assembly according to claim 2, wherein said lever is pivotably mounted on a lever fulcrum.

5. The trigger assembly according to claim 4, wherein said sear cam engages said lever on one side of said lever fulcrum and said contact surface is positioned on said one side of said lever fulcrum.

6. The trigger assembly according to claim 4, wherein said trigger is pivotably mounted on a trigger fulcrum.

7. The trigger assembly according to claim 6, wherein said trigger comprises an actuation arm and a projection extending transversely thereto, said projection being engageable with said trigger cam.

8. The trigger assembly according to claim 6, wherein said trigger return pendulum is pivotably mounted on a trigger return pendulum fulcrum.

9. The trigger assembly according to claim 8, wherein said lever cam engages said lever on an opposite side of said lever fulcrum from said contact surface.

10. The trigger assembly according to claim 8, wherein said trigger return pendulum fulcrum is positioned at one end of said trigger return pendulum, said lever cam is positioned at an opposite end of said trigger return pendulum, and said trigger cam is positioned between said ends of said trigger return pendulum.

11. The trigger assembly according to claim 8, further comprising first and second sideplates attached to one another in spaced apart relation, said sear, said lever, said trigger and said trigger return pendulum being mounted between said sideplates.

12. The trigger assembly according to claim 11, wherein said sear fulcrum, said lever fulcrum, said trigger fulcrum and said trigger return pendulum fulcrum each comprises a respective pin extending between said sideplates.

13. A trigger assembly for a firearm having a reciprocating component, said trigger assembly comprising:

first and second sideplates arranged in parallel, spaced apart relation;

a sear pin extending between said first and second sideplates;

a sear pivotally mounted on said sear pin, said sear having a stop surface engageable with said reciprocating component for holding said reciprocating component in a cocked configuration, said sear further comprising a sear cam;

a lever pivot pin extending between said first and second sideplates;

a lever pivotally mounted on said lever pivot pin, said lever having a contact surface, said sear cam engaging said lever;

a trigger pivot pin extending between said first and second sideplates;

a trigger pivotally mounted on said trigger pivot pin, said trigger having an action surface movable into and out of engagement with said contact surface upon motion of said trigger;

a spring acting on said lever and biasing said contact surface out of engagement with said action surface;

a trigger return pendulum pin extending between said first and second sideplates;

a trigger return pendulum pivotally mounted on said trigger return pendulum pin, said trigger return pendulum having a trigger cam engageable with said trigger, a lever cam engageable with said lever, and a head cam follower engageable with said reciprocating component; wherein motion of said reciprocating component acting through said head cam follower of said trigger return pendulum forces said lever cam into engagement with said lever and said trigger cam into engagement with said trigger to return said lever and said trigger to a configuration of engagement between said action surface and said contact surface.

14. The trigger assembly according to claim 13, wherein said stop surface is angularly oriented relatively to a line of motion of said reciprocating component to permit said reciprocating component to pivot said sear about said sear pin upon motion of said reciprocating component along said line of motion against said stop surface.

15. The trigger assembly according to claim 13, wherein said sear cam engages said lever on one side of said lever pivot pin and said contact surface is positioned on said one side of said lever pivot pin.

16. The trigger assembly according to claim 13, wherein said trigger comprises an actuation arm and a projection extending transversely thereto, said projection being engageable with said trigger cam.

17. The trigger assembly according to claim 13, wherein said lever cam engages said lever on an opposite side of said lever pivot pin from said contact surface.

18. The trigger assembly according to claim 13, wherein said trigger return pendulum pin is positioned at one end of said trigger return pendulum, said lever cam is positioned at an opposite end of said trigger return pendulum, and said trigger cam is positioned between said ends of said trigger return pendulum.

19. A firearm, said firearm comprising:

a reciprocating component;

a trigger assembly comprising:

a sear movably mounted within said assembly, said sear having a stop surface engageable with said reciprocating component for holding said reciprocating component in a cocked configuration, said sear further comprising a sear cam;

a lever movably mounted within said assembly, said lever having a contact surface, said sear cam engaging said lever;

a trigger movably mounted within said assembly, said trigger having an action surface movable into and out of engagement with said contact surface upon motion of said trigger;

a spring acting on said lever and biasing said contact surface out of engagement with said action surface;

a trigger return pendulum movably mounted within said assembly, said trigger return pendulum having a trigger cam engageable with said trigger, a lever cam engageable with said lever, and a head cam follower engageable with said reciprocating component; wherein motion of said reciprocating component acting through said head cam follower of said trigger return pendulum forces said lever cam into engagement with said lever and said trigger cam into engagement with said trigger to return said lever and said trigger to a configuration of engagement between said action surface and said contact surface.

20. The firearm according to claim 19, wherein said sear is pivotably mounted on a sear fulcrum.

21. The firearm according to claim 20, wherein said stop surface is angularly oriented relatively to a line of motion of said reciprocating component to permit said reciprocating component to pivot said sear about said sear fulcrum upon motion of said reciprocating component along said line of motion against said stop surface.

22. The firearm according to claim 20, wherein said lever is pivotably mounted on a lever fulcrum.

23. The firearm according to claim 22, wherein said sear cam engages said lever on one side of said lever fulcrum and said contact surface is positioned on said one side of said lever fulcrum.

24. The firearm according to claim 22, wherein said trigger is pivotably mounted on a trigger fulcrum.

25. The firearm according to claim 24, wherein said trigger comprises an actuation arm and a projection extending transversely thereto, said projection being engageable with said trigger cam.

26. The firearm according to claim 24, wherein said trigger return pendulum is pivotably mounted on a trigger return pendulum fulcrum.

27. The firearm according to claim 26, wherein said lever cam engages said lever on an opposite side of said lever fulcrum from said contact surface.

28. The firearm according to claim 26, wherein said trigger return pendulum fulcrum is positioned at one end of said trigger return pendulum, said lever cam is positioned at an opposite end of said trigger return pendulum, and said trigger cam is positioned between said ends of said trigger return pendulum.

29. The firearm according to claim 26, further comprising first and second sideplates attached to one another in spaced apart relation, said sear, said lever, said trigger and said trigger return pendulum being mounted between said sideplates.

30. The firearm according to claim 29, wherein said sear fulcrum, said lever fulcrum, said trigger fulcrum and said trigger return pendulum fulcrum each comprises a respective pin extending between said sideplates.

31. The firearm according to claim 19, wherein said firearm comprises a bolt action rifle and said reciprocating component comprises a firing pin head.

32. The firearm according to claim 19, wherein said firearm comprises a semi-automatic rifle and said reciprocating member comprises a bolt carrier.

33. The firearm according to claim 19, wherein said firearm comprises an automatic rifle and said reciprocating member comprises a bolt carrier.

34. The firearm according to claim 19, wherein said firearm comprises a pistol and said reciprocating member comprises a slide.

* * * * *